US006066050A

United States Patent [19]

Rothbard

[11] Patent Number: 6,066,050

[45] Date of Patent: May 23, 2000

[54] PLAYGROUND APPARATUS WITH CHANNELS THROUGH WHICH OBJECTS AND MATERIALS ARE PASSED

[76] Inventor: Robert K. Rothbard, P.O. Box 593, Galveston, Tex. 77553

[21] Appl. No.: 09/042,472

[22] Filed: Mar. 16, 1998

Related U.S. Application Data

[63] Continuation-in-part of application No. 08/622,997, Jun. 17, 1996, Pat. No. 5,728,005.

[51] Int. Cl.[7] ..... A63G 21/00

[52] U.S. Cl. ..... 472/116; 472/117

[58] Field of Search ..... 472/116, 117, 472/126; 104/69, 70; 446/227, 168

[56] References Cited

U.S. PATENT DOCUMENTS

| | | | |
|---|---|---|---|
| 2,917,864 | 12/1959 | Payne | 446/168 |
| 2,982,547 | 5/1961 | Carrier | 472/117 |
| 5,169,317 | 12/1992 | Hollander | 446/168 X |
| 5,741,189 | 4/1998 | Briggs | 472/128 |

FOREIGN PATENT DOCUMENTS

| | | | |
|---|---|---|---|
| 2 202 755 | 10/1988 | United Kingdom | 472/116 |

*Primary Examiner*—Kien T. Nguyen
*Attorney, Agent, or Firm*—Kenneth A. Roddy

[57] ABSTRACT

A slide or chute having an elongate bedway with a longitudinal portion on which a person slides is provided with at least one longitudinally extending tubular channel having an opening at an upper end and an opening at a lower end through which objects and materials may be passed from the upper end and discharged from the lower end. The tubular channels may be formed integral with the slide or chute or may be provided as separate members for attachment to existing slides, chutes, and support columns. The tubular channels may be disposed on an underside of the bedway, on laterally opposed sides of the bedway, and on curved hood portions with a pair of elongate tubular channels extending therefrom along laterally opposed sides of the bedway each having an opening at a lower end. Longitudinal tubular channels may also be connected with the elevated deck support structure from which the upper end of the slide or chute is supported. Passing materials through the channels provides amusement and at the same time replaces material beneath the exit end of the bedway or beneath the deck which may otherwise be worn way or displaced after a period of time by the foot traffic of persons using the slide.

22 Claims, 7 Drawing Sheets

PLAYGROUND APPARATUS WITH CHANNELS THROUGH WHICH OBJECTS AND MATERIALS ARE PASSED

CROSS-REFERENCE TO RELATED APPLICATION

This application is a continuation-in-part of U.S. patent application Ser. No. 08/622,997, filed Jun. 17, 1996, now U.S. Pat. No. 5,728,005.

BACKGROUND OF THE INVENTION

1. Field of the Invention

This invention relates generally to playground apparatus such as slides and chutes, and more particularly to such playground apparatus having at least one longitudinally extending tubular channel with an opening at an upper end and an opening at a lower end through which objects and materials may be passed from the upper end and discharged from the lower end to provide amusement and also replace material beneath the slide or support structure which may otherwise be worn way or displaced after a period of time by the foot traffic of persons using the slide.

2. Brief description of the Prior Art

A typical playground slide or chute has an inclined elongate longitudinal bedway along which a person slides. The upper end of the slide or chute may be supported at the top of a ladder or a deck supported a distance above the ground surface by posts or columns. The longitudinal bedway of slides and chutes incorporate a variety of sliding path configurations, such as curved or spiral, and may have have hoods at the entrance to the bedway the require the user to sit down before getting on the bedway. In some instances the slides and chutes may have a plurality of laterally adjacent bedways. Many prior art slides have a longitudinal side wall at each lateral side of the bedway, and an outwardly rounded or tubular hand rail at the top of each side wall.

More recently, playground slides and chutes and water slides of molded plastic construction have been developed. Some molded slides have a longitudinal side wall at each lateral side of the bedway and/or an outwardly rounded surface along laterally opposed sides of the longitudinal portion on which a person slides which serves as a hand rail. Other conventional molded slides and chutes are hollow cylindrical tunnel-like configurations or have a hood which covers at least the upper portion or entrance to the bedway. Still others are connected at their upper end with an elevated deck.

In most installations the ground surface surrounding the slide or chute is covered with loose or soft materials such as sand, sawdust, loose soil, wood bark, or other materials for safety purposes. However, it is common for the loose material to become displaced or worn away after periods of continued use due to the foot traffic of the users.

As a result, pathways are worn in the ground cover beneath the deck and deep depressions are commonly formed in the ground surface at the bottom of a slide or chute. These pathways and depressions present a hazard to children playing on the equipment and can cause falling or damage to the muscles or ligaments and/or injury to the foot, ankle and legs of the users. These pathways and depressions will also become filled with water following a rain making the playground equipment unusable for a period of time.

It would therefore be desirable to provide a means for replacing the loose ground cover materials beneath the deck and slide to prevent deep depressions and pathways from forming in the ground surface at the bottom of the slide, chute or deck. The present invention provides a solution to this problem, and in addition to reducing the likelihood of injury to children playing on the equipment, provides amusement for the children using the equipment and thus facilitates its continued implementation.

Various playground slides and chutes are known in the art, however none address the problem solved by the present invention.

Thornton, U.S. Pat. No. 1,680,753 discloses a slide of galvanized steel construction having an inclined elongate longitudinal bedway, upwardly bent side walls at each lateral side of the bedway, a cylindrical roll at the top of each side wall, and a pipes disposed vertically above each side wall which are secured in sockets at their upper ends.

Lamar, U.S. Pat. No. 1,888,350 discloses a sheet metal slide having an inclined elongate longitudinal bedway, and inverted U-shaped rails or tubular rails at each lateral side of the bedway which are closed at their top and bottom ends by metal plugs. The rails are secured to the bedway by bolts which pass through the center of the rails.

Ahrens, U.S. Pat. No. 4,811,943 discloses a hollow cylindrical molded slide having an elongate longitudinal spiral bedway. The lowermost section is a U-shaped apron having upwardly facing lateral side edges with protective tubes extending along the side edges of the apron section.

The present invention is distinguished over the prior art in general, and these patents in particular by playground apparatus such as slides or chutes having an elongate bedway with a longitudinal portion on which a person slides and at least one longitudinally extending tubular channel having an opening at an upper end and an opening at a lower end through which objects and materials may be passed from the upper end and discharged from the lower end. The tubular channels may be formed integral with the slide or chute or may be provided as separate members for attachment to existing slides, chutes, and support columns. The tubular channels may be disposed on an underside of the bedway, on laterally opposed sides of the bedway, and on curved hood portions with a pair of elongate tubular channels extending therefrom along laterally opposed sides of the bedway each having an opening at a lower end. Longitudinal tubular channels may also be connected with the elevated deck support structure from which the upper end of the slide or chute is supported. Passing materials through the channels provides amusement and at the same time replaces material beneath the exit end of the bedway or beneath the deck which may otherwise be worn way or displaced after a period of time by the foot traffic of persons using the slide.

SUMMARY OF THE INVENTION

It is therefore an object of the present invention to provide a slide or chute having an elongate bedway on which a person slides that has at least one longitudinally extending tubular channel having an opening at an upper end and an opening at a lower end through which objects and materials may be passed from the upper end and discharged from the lower end.

It is another object of this invention to provide an elongate tubular channel which can be easily and quickly attached to the bedway and other surfaces of existing slides, chutes, or support structures and through which materials may be passed.

Another object of this invention is to provide an elongate tubular channel which can be easily and quickly attached to an elevated deck to which a slide or chute is connected and through which materials may be passed.

Another object of this invention is to provide slides and chutes having an elongate bedway with one or more integrally formed tubular channels through which materials may be passed.

Another object of this invention is to provide hooded slides and chutes having an elongate bedway with one or more integrally formed tubular channels through which materials may be passed.

A further object of this invention is to provide the support columns of an elevated deck that supports a slide or chute with one or more integrally formed tubular channels through which materials may be passed.

A still further object of this invention is to provide slides, chutes and elevated decks having at least one longitudinally extending tubular channel with an opening at an upper end and an opening at a lower end through which materials may be passed from the upper end and discharged from the lower end for amusement and to replace material beneath the exit end of the bedway or beneath the deck which is worn way or displaced after a period of time by the feet of the persons using the slide.

Other objects of the invention will become apparent from time to time throughout the specification and claims as hereinafter related.

The above noted objects and other objects of the invention are accomplished by playground apparatus such as slides or chutes having an elongate bedway with a longitudinal portion on which a person slides and at least one longitudinally extending tubular channel having an opening at an upper end and an opening at a lower end through which objects and materials may be passed from the upper end and discharged from the lower end. The tubular channels may be formed integral with the slide or chute or may be provided as separate members for attachment to existing slides, chutes, and support columns. The tubular channels may be disposed on an underside of the bedway, on laterally opposed sides of the bedway, and on curved hood portions with a pair of elongate tubular channels extending therefrom along laterally opposed sides of the bedway each having an opening at a lower end. Longitudinal tubular channels may also be connected with the elevated deck support structure from which the upper end of the slide or chute is supported. Passing materials through the channels provides amusement and at the same time replaces material beneath the exit end of the bedway or beneath the deck which may otherwise be worn way or displaced after a period of time by the foot traffic of persons using the slide.

DESCRIPTION OF THE PREFERRED EMBODIMENTS

Figure 1:
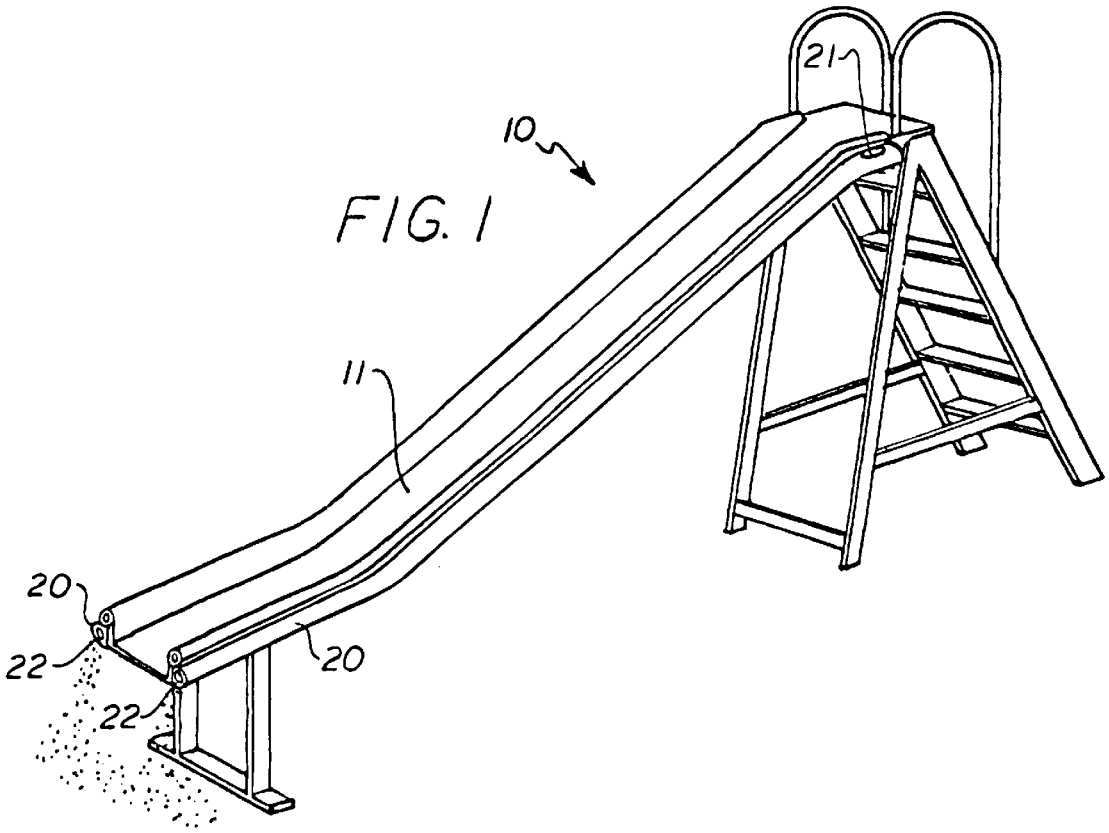
FIG. 1 is a perspective view of a slide device provided with a tubular channel adjacent to each lateral side of the bedway in accordance with the present invention.

Referring to the drawings by numerals of reference, there is shown in FIG. 1, a playground slide 10 having an elongate bedway 11 provided with a tubular channel 20 adjacent to each lateral side of the bedway. Each tubular channel 20 has an opening 21 at an upper end and an opening 22 at a lower end through which objects and materials may be passed from the upper end and discharged from the lower end. The tubular channels 20 may be separate members adapted to be attached to existing slides and chutes or may be formed integral with the slide or chute as described hereinafter.

Figure 2:
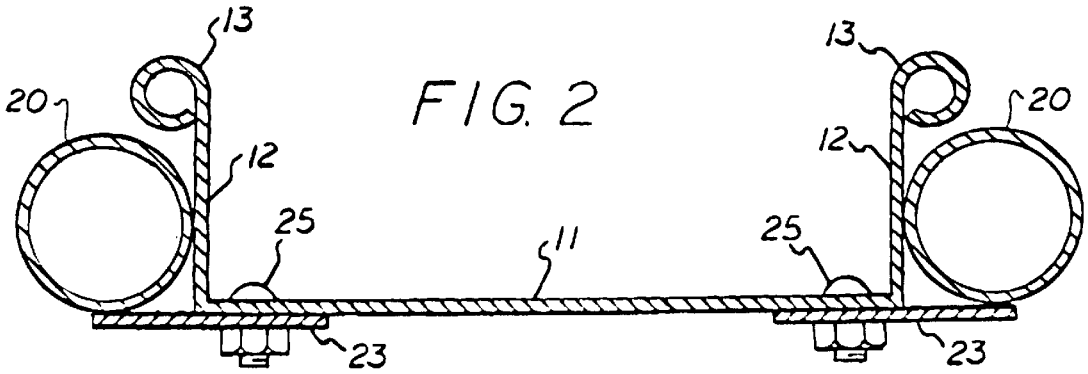
FIG. 2 is a transverse cross section through a portion of the bedway of a typical playground slide of metal construction provided with tubular channels in accordance with the present invention.

FIG. 2 shows, in transverse cross section, a portion of the inclined longitudinal bedway 11 of a typical playground slide of metal construction. Slides of this type have a longitudinal side wall 12 at each lateral side of the bedway 11, and an outwardly rounded or tubular handrail 13 at the top of each side wall which is formed by rolling the top edge of the side wall over to form a cylindrical configuration.

In accordance with the present invention, an elongate longitudinal tubular channel 20 is secured adjacent to each lateral side of the bedway 11. The tubular channels 20 are preferably formed of a semi-rigid weather resistant plastic material. It should be understood that the tubular channels 20 may also be formed of metal, fiberglass, rubber, or other suitable materials, and may also be flexible.

In FIGS. 1 and 2, the tubular channel 20 is shown as being generally circular in cross section and is secured to the bedway 11 of the slide such that it is disposed along the outer longitudinal side of each side wall 12 and handrail 13. The channels 20 may be secured to the slide by any conventional fastening means, such as welding, epoxy, screw type fasteners, or bolting, depending upon the materials used for the handrails. In the example of FIG. 2, each tubular channel 20 has a series of longitudinally spaced tabs 23 along its length which extend laterally outward from its bottom surface and are used to attach the channel 20 to the slide. The tabs 23 of the tubular channels 20 are epoxied to the bottom surface of the channel and secured to the bedway 11 of the slide by bolts and nuts 25.

Figure 3:
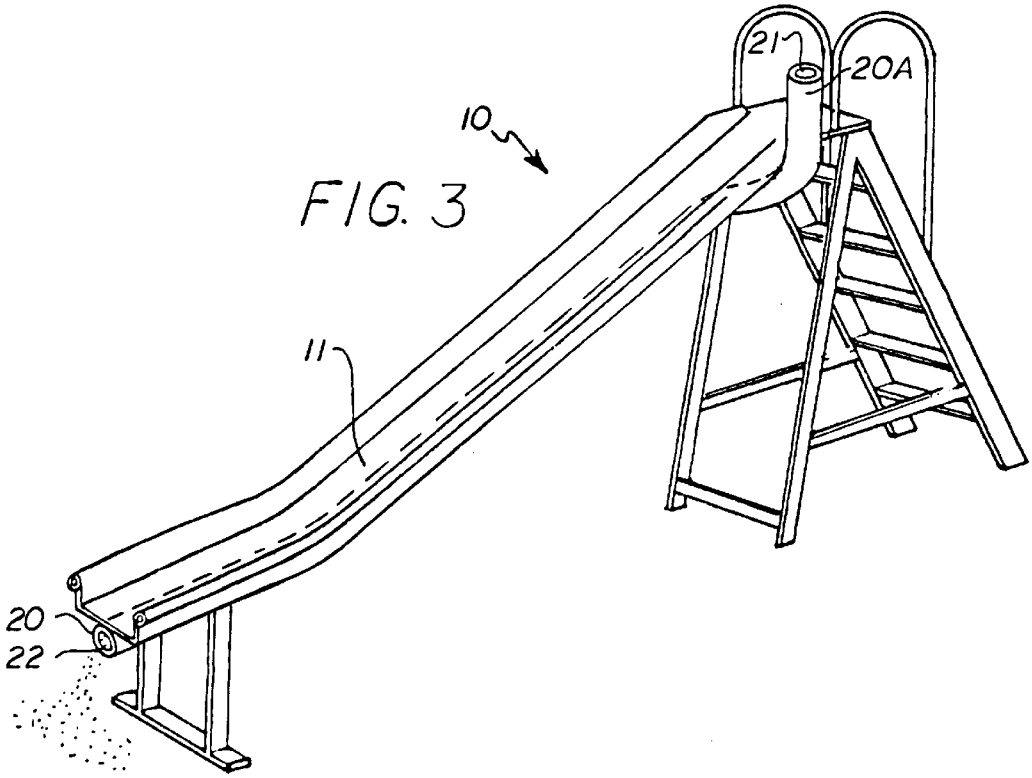
FIG. 3 is a perspective view of a playground slide having an elongate bedway with a tubular channel extending along the underside of the bedway.

FIG. 3 shows a playground slide 10 having an elongate bedway 11 provided with a tubular channel 20 extending along the underside of the bedway 11. In this embodiment, the upper portion 20A of the tubular channel 20 ends outwardly and upwardly adjacent to the upper end of the bedway 11 and has an opening 21 at its upper end and an opening 22 at its lower end through which objects and materials may be passed from the upper end and discharged from the lower end.

Figure 4:
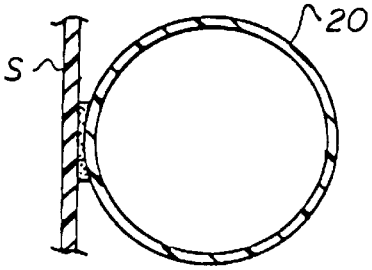
FIG. 4 is a transverse cross section showing a tubular channel in accordance with the present invention attached to the side wall of an existing slide adjacent to the existing bedway by epoxy, glue or other suitable fastening means.
Figure 5:
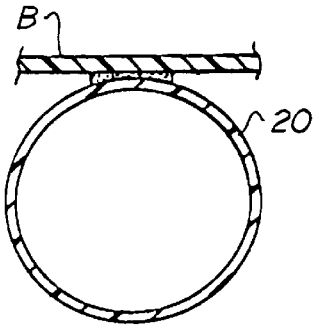
FIG. 5 is a transverse cross section showing a tubular channel in accordance with the present invention attached to the underside of the bedway of an existing slide by epoxy, glue or other suitable fastening means.

FIG. 4 shows, in transverse cross section, a tubular channel 20 which is circular in cross section, and which is attached to the side wall S of an existing slide adjacent to the existing bedway by epoxy, glue or other suitable fastening means. FIG. 5 shows, in transverse cross section, a tubular channel 20 which is circular in cross section, and which is attached to the underside of the bedway B of an existing slide by epoxy, glue or other suitable fastening means.

Although in the illustrated examples the tubular channels 20 are shown as circular in cross section, it should be understood that the tubular channels may have various other cross sectional configurations such as oval, square, or polygonal cross sections. It should also be understood that, although the slide depicted in FIGS. 1 and 3 show an elongate longitudinal generally straight inclined bedway, it should be understood that the slide or chute may also have an elongate spiral bedway.

Figure 6:
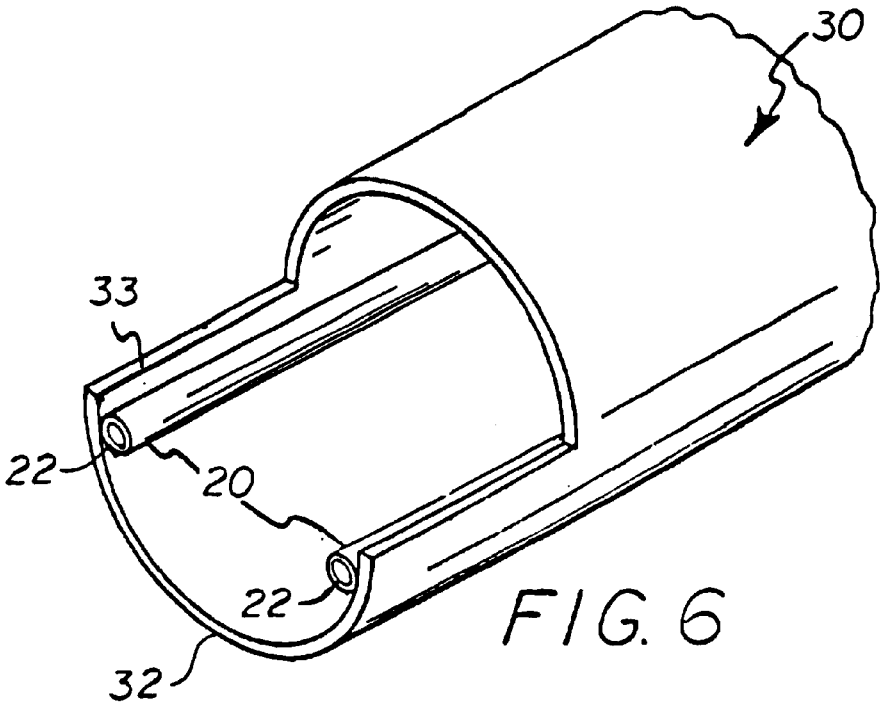
FIG. 6 is a perspective view showing a portion of a tunnel-type slide of hollow generally cylindrical configuration with tubular channels installed on the interior surface in laterally opposed relation.

FIG. 6 shows a portion of a tunnel-type slide or chute 30 which is a hollow generally cylindrical configuration and the interior thereof 31 forms the elongate bedway 32. For this type of slide or chute, the tubular channels 20 are secured on the interior surface of the side wall 33 in laterally opposed relation by conventional fastening means such as epoxy, welding, screw type fasteners, or bolting, depending upon the materials of the chute and tubular channels.

The tubular channels may also be formed integrally with the slide or chute by conventional molding and assembly techniques known to those skilled in the art. For example, the circular channel configuration may be made in two semicircular halves, one of which is formed in the side wall of the bedway and the other half molded as a separate piece and then bonded onto the side wall to form the circular channel.

Figure 7:
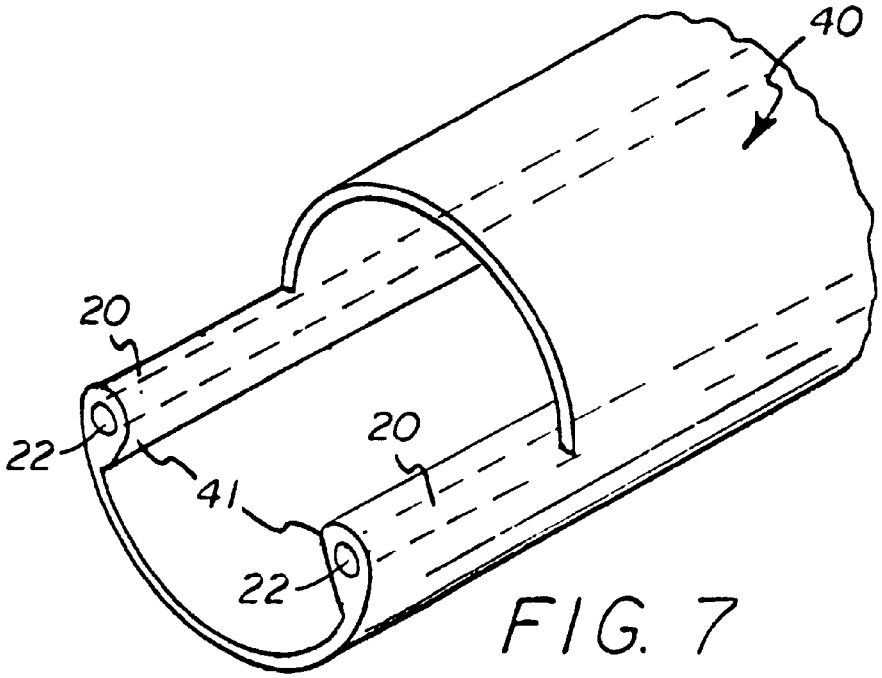
FIG. 7 is a perspective view showing a portion of a tunnel-type slide having a pair of integrally formed tubular channels on its interior surface.

FIG. 7 shows a tunnel-type slide or chute 40 having a hollow generally cylindrical configuration and a pair of circular tubular channels 20 integrally formed on its interior surface 41 in laterally opposed relation. Each tubular channel 20 has an opening at its upper end (not shown) and an opening 22 at its lower end through which objects and materials may be passed from the upper end and discharged from the lower end.

Figure 8:
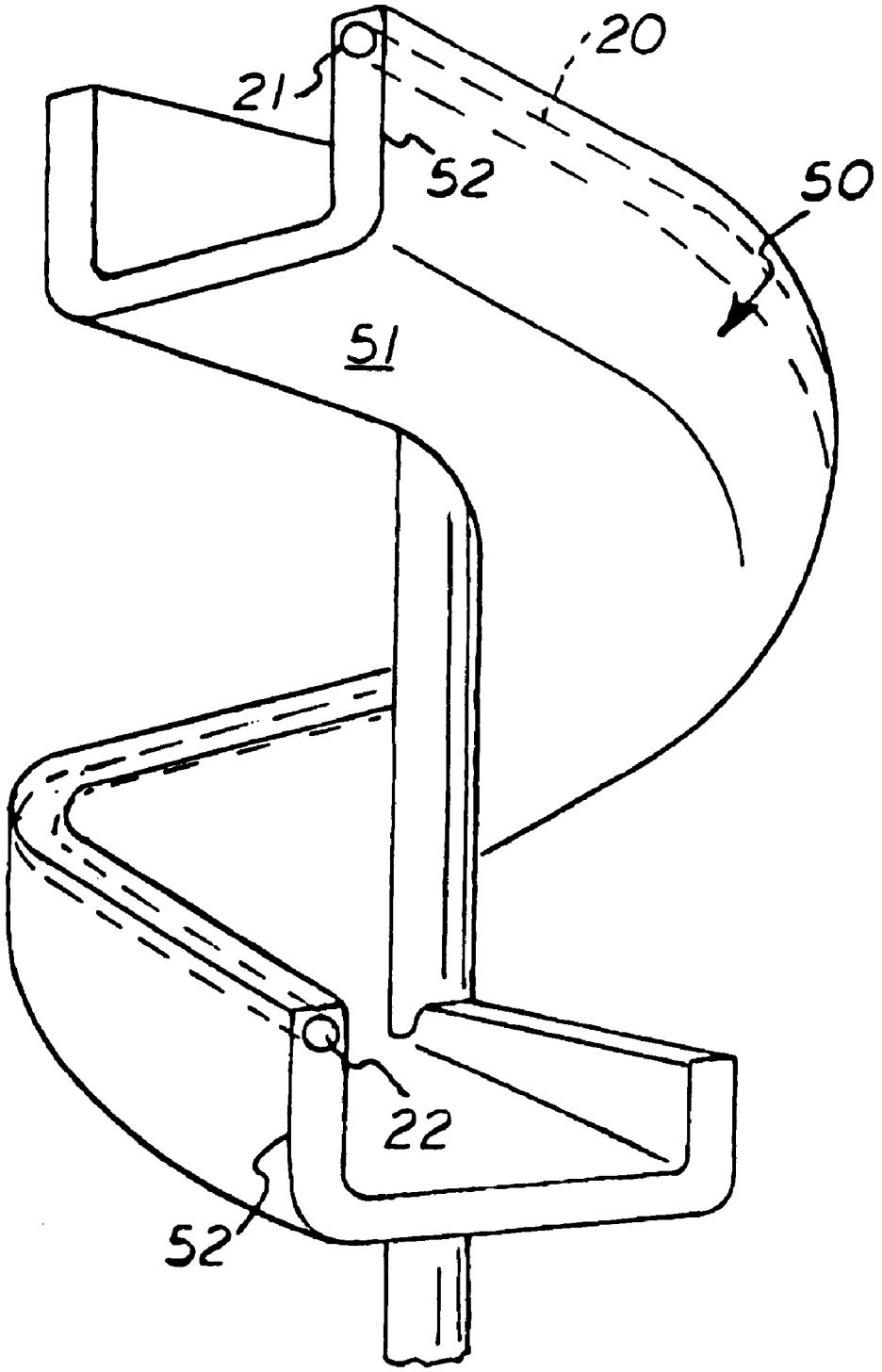
FIG. 8 is a perspective view of a slide with an elongate spiral bedway having an tubular channel along the outer side wall of the bedway.

FIG. 8 shows a slide 50 having an elongate spiral bedway 51 with an upstanding longitudinal side wall 52 at the outer side of the bedway, and a tubular channel 20 extending along the upper portion of the outer side wall. The tubular channel 20 has an opening 21 at its upper end and an opening 22 at its lower end through which objects and materials may be passed from the upper end and discharged from the lower end.

Figure 9:
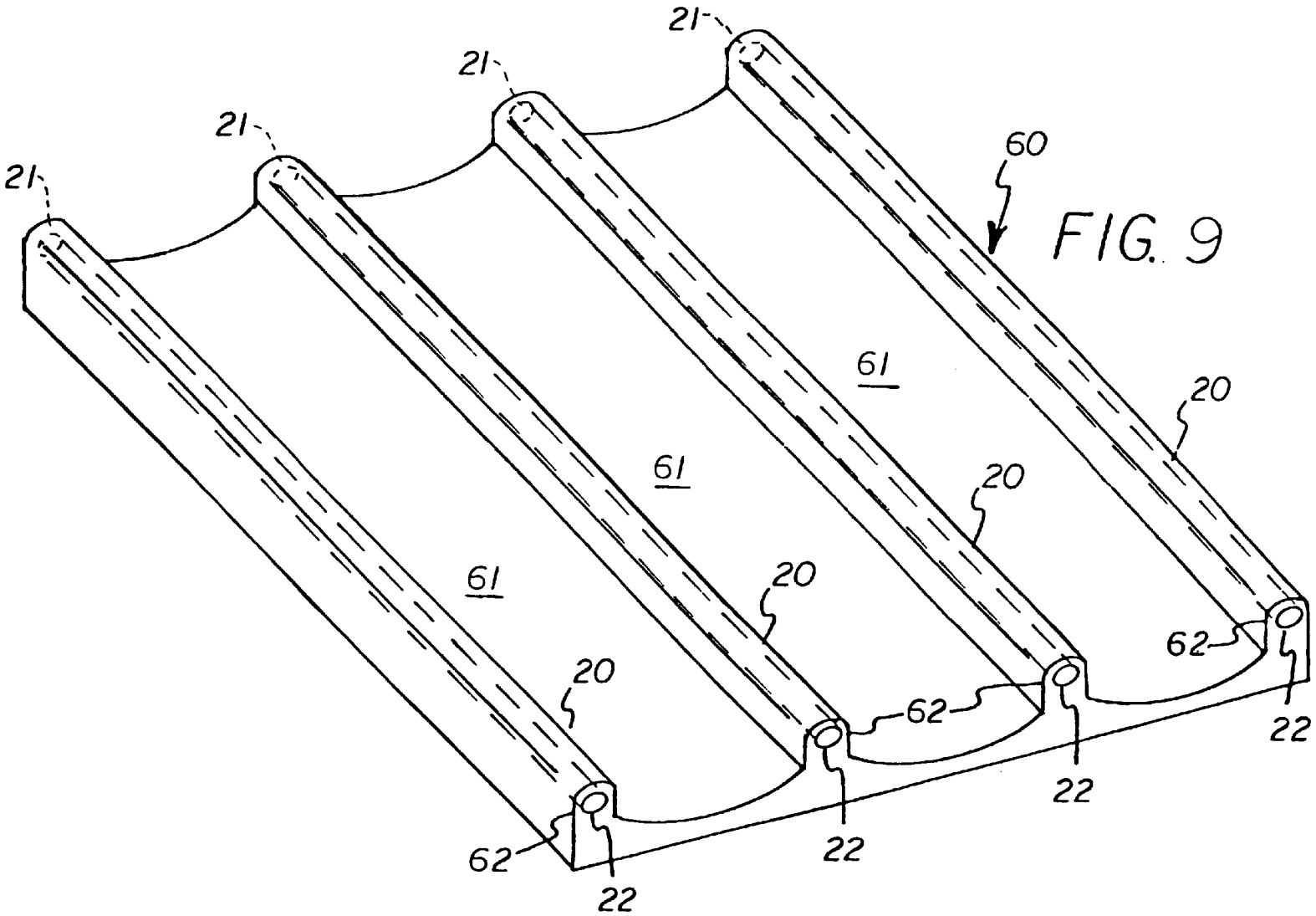
FIG. 9 is a perspective view of a portion of a slide having adjacent elongate bedways with tubular channels integrally formed in the side walls between each bedway.

FIG. 9 shows a slide 60 having adjacent elongate bedways 61 with an upstanding longitudinal side wall 62 at each side of each bedway, and a tubular channel 20 along the upper portion of each side wall. Each tubular channel 20 has an opening 21 at its upper end and an opening 22 at its lower end through which objects and materials may be passed from the upper end and discharged from the lower end.

Figures 10, 10A:
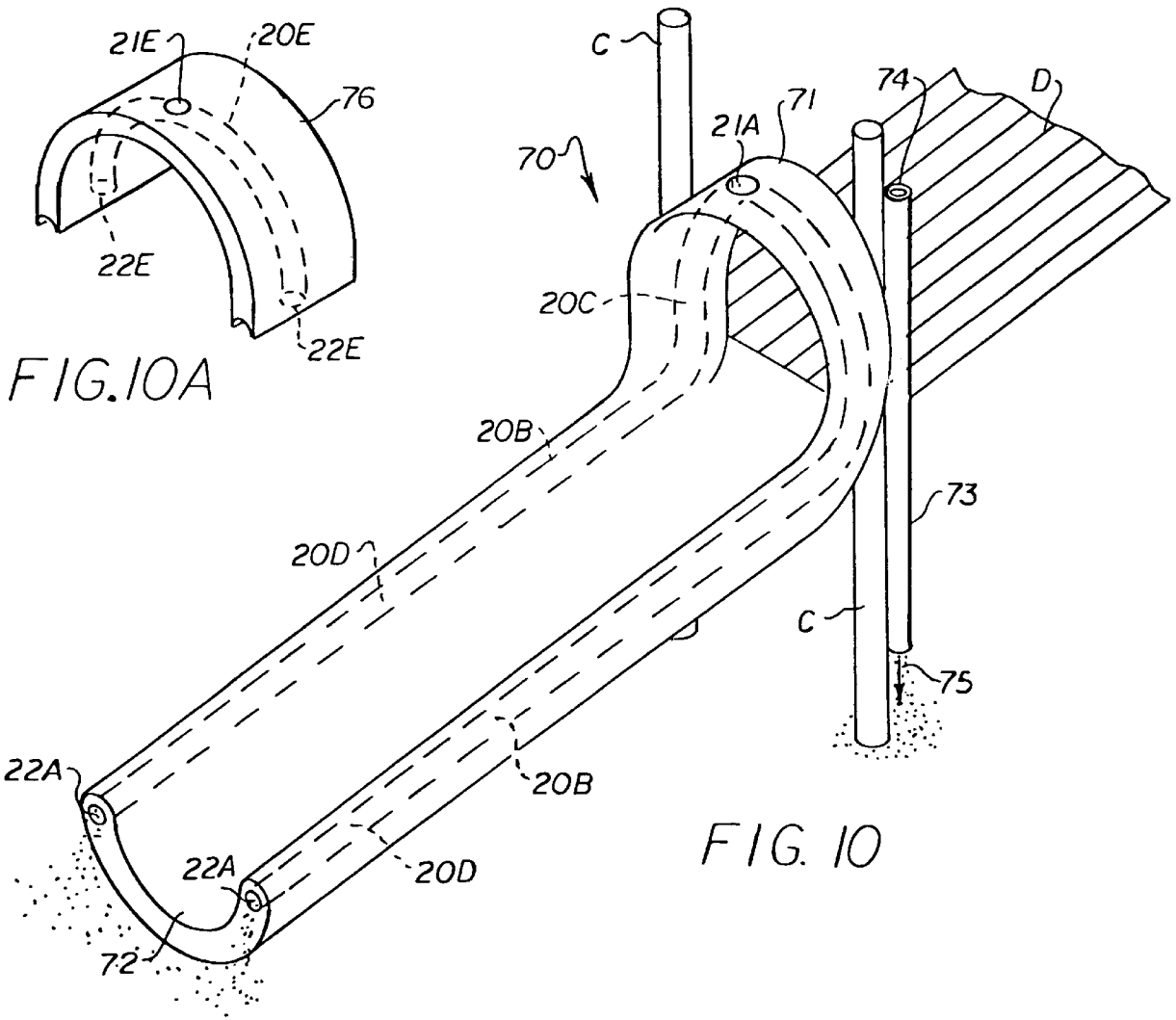
FIG. 10 is a perspective view of a slide having a hood portion with a tubular channel in the hood portion and tubular channels along laterally opposed sides of the bedway, and showing a tubular channel secured to one of the columns which supports the deck.
FIG. 10A is a perspective view of a hood having a tubular channel which is adapted to be installed on a slide.

FIG. 10 shows a slide 70 of the type having a hood portion 71 at its upper end which is designed to make the person using the slide to sit down before getting on to the bedway 72. In these types of hooded slides, a tubular channel 20B is provided which has an outwardly curved upper portion 20C in or on the hood with an opening 21A therein and a pair of elongate tubular channels 20D extending therefrom along laterally opposed sides of the bedway, each having an opening 22A at a lower end thereof. The curved upper portion 20C and the laterally spaced tubular channels 20D may be integrally formed in the hood 71 and along the laterally opposed sides of the bedway 17, respectively, or the curved and longitudinal channels 20C and 20D may be provided as separate units that are attached to the hood and the laterally opposed side of the bedway.

Also shown in FIG. 10 is a modification wherein an elongate tubular channel 73 is secured to the exterior of one of the columns C which support a deck D and has an opening 74 at its upper end adjacent to upper end of the column an opening 75 at its lower end disposed a distance above the ground surface adjacent the lower portion of the column. In this modification, objects and materials may be passed from the opening 74 in the upper end of the tubular channel 73 and discharged from the opening 75 in the lower end of the channel by a person sanding on the deck D.

FIG. 10A is a perspective view of a hood 76 which is provided as a separate unit and is adapted to be attached to an existing slide which has channels on the laterally opposed sides of its bedway. The hood 76 is provided with an outwardly curved tubular channel 20E in or on the curved portion of the hood that has an opening 21E at its top portion and an opening 22E at the laterally opposed bottom ends of the curved tubular channel. Objects and materials may be passed from the opening 21E in the curved portion of the tubular channel 20D and discharged from the laterally opposed openings 22E at the bottom ends of the channel into the channels of the existing slide.

Figure 11:
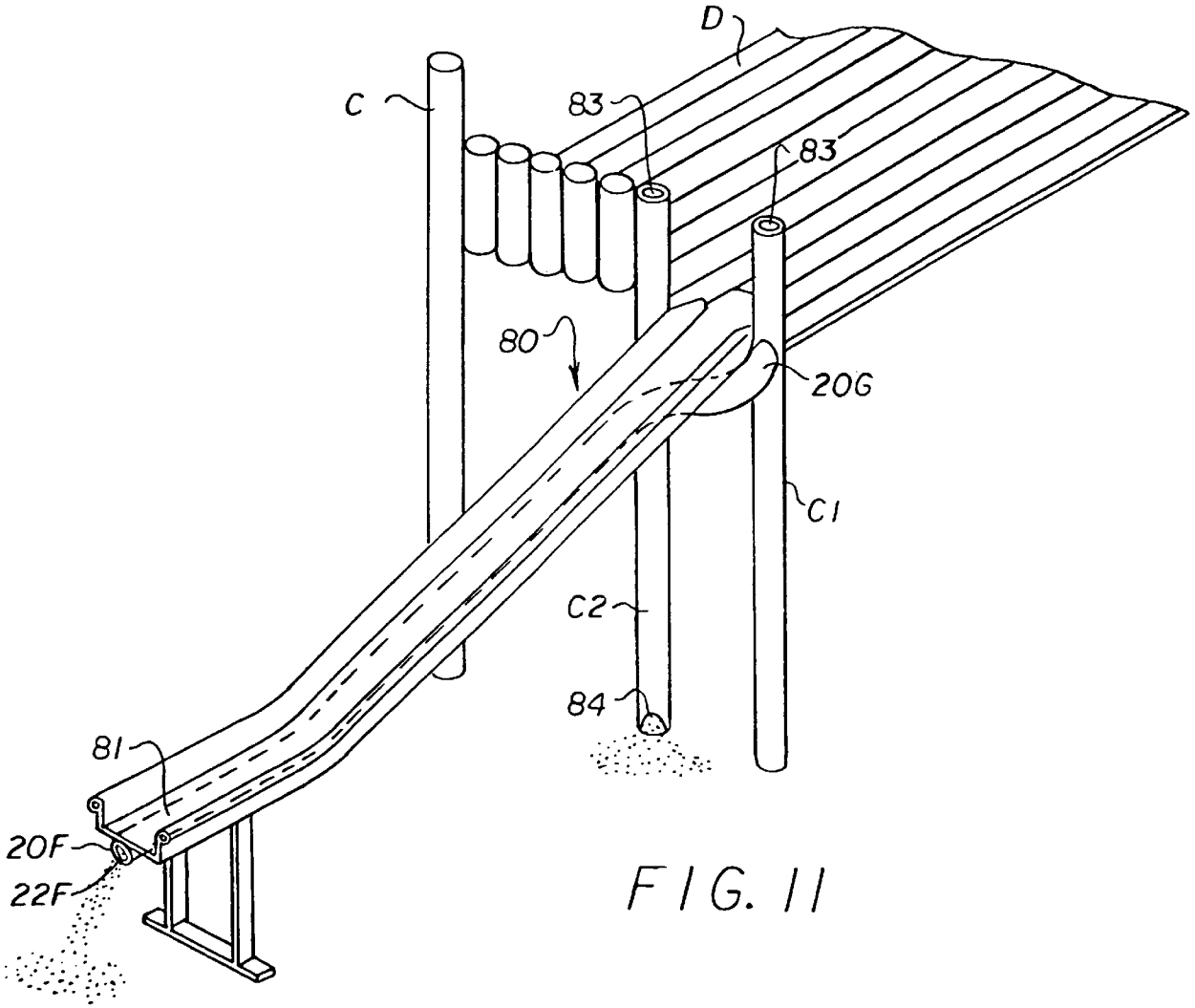
FIG. 11 is a perspective view of a slide connected at its upper end to a deck with a tubular channel extending along the underside bedway that has an upper portion adjoining a vertical column supporting the deck, and showing one of the columns having an opening at its upper end and an opening at its lower end.

FIG. 11 shows a slide 80 of the type which is connected at its upper end to a deck D supported a distance above the ground surface by vertical columns. In this embodiment, the slide 80 is provided with a tubular channel 20F extending along the underside of the bedway 81. The upper portion 20G of the tubular channel 2OF extends outwardly and upwardly adjacent to the upper end of the bedway 81 and adjoins a column C1. The upper end of the column C1 has an opening 82 at its upper end which extends downwardly and adjoins the upper end 20G of the tubular channel 20F. In this embodiment, objects and materials may be passed from the opening 82 in the upper end of the column C1 and discharged from the opening 22F in the lower end of the tubular channel 20F.

Also shown in FIG. 11 is a modification wherein one of the columns C2 which support the deck D is a hollow tubular column having an opening 83 at its upper end and an opening 84 at its lower end above the ground surface. In this modification, objects and materials may be passed from the opening 83 in the upper end of the tubular column C2 and discharged from the opening 84 at the lower end of the column.

Children playing on the playground apparatus can gather up a quantity of the loose or soft materials such as sand, sawdust, loose soil, wood bark, surrounding the slide or deck and pour it into the channel opening at the top of the slide, deck, or column, and watch it exit at the lower end of the channel.

It can be seen from the foregoing description that the tubular channels of the present invention provide a means for replacing the loose ground cover materials beneath the deck and slide to prevent deep depressions and pathways from forming in the ground surface at the bottom of the slide, chute or deck, thus, reducing the likelihood of injury to children playing on the equipment.

Passing objects and materials through the tubular channels additionally provides a means of amusement for children playing on the equipment and thus facilitates continued replacement of the loose ground cover materials beneath the deck and slide to prevent the formation of deep depressions and pathways.

While this invention has been described fully and completely with special emphasis upon several preferred embodiments, it should be understood that within the scope of the appended claims the invention may be practiced otherwise than as specifically described herein.

I claim:

1. A playground apparatus comprising:

a slide including an elongate bedway having a longitudinal portion extending from an upper end to a lower end on which a person slides;

support means for supporting said elongate bedway upper end a distance above a ground surface; and a longitudinally extending tubular channel on said bedway having an opening at an upper end and an opening at a lower end through which objects and materials are passed from said channel upper end and discharged from said channel lower end.

2. A playground apparatus according to claim 1 further comprising means for securing said tubular channel on said bedway.

3. A playground apparatus according to claim 1 wherein said tubular channel is integrally formed on said bedway.

4. A playground apparatus according to claim 1 wherein said tubular channel is disposed on an underside of said bedway.

5. A playground apparatus according to claim 1 wherein said tubular channel is disposed on laterally opposed sides of said bedway.

6. A playground apparatus according to claim 1 wherein said elongate bedway has an upstanding longitudinal side wall and a handrail on at least one side of said longitudinal portion; and a said tubular channel is disposed adjacent to said side wall and said handrail.

7. A playground apparatus according to claim wherein said opening in said tubular channel upper end is connected with said support means.

8. A playground apparatus according to claim 7 wherein said support means is a deck elevated a distance above said ground surface; and said opening in said tubular channel upper end is disposed adjacent to said deck whereby objects and materials are passed from said opening in said channel upper end and discharged from said opening at said channel lower end by a person standing on said deck.

9. A playground apparatus according to claim 7 wherein said support means includes at least one vertical column; and said opening in said tubular channel upper end is disposed adjacent to said column whereby objects and materials are passed from said opening in said channel upper end and discharged from said opening at said lower end of said tubular channel.

10. A playground apparatus according to claim 9 wherein said at least one vertical column has an opening at an upper end; and said opening in said tubular channel upper end is connected with said opening at said column upper end whereby objects and materials are passed from said opening in said vertical column upper end, through said opening in said tubular channel upper end and discharged from said opening at said lower end of said tubular channel.

11. A playground apparatus according to claim 1 wherein said support means for supporting said elongate bedway upper end a distance above a ground surface includes at least one vertical column;

said at least one vertical column having an opening at an upper end and an opening at a lower end through which objects and materials are passed from said opening in said column upper end and discharged from said opening in said column lower end.

12. A playground apparatus comprising:

a slide including an elongate bedway having a longitudinal portion extending from an upper end to a lower end on which a person slides, said elongate bedway having a hood portion at an upper end;

support means for supporting said elongate bedway upper end a distance above a ground surface; and a longitudinally extending tubular channel on said bedway having an upper portion associated with said hood portion, an opening in said upper portion, and an elongate tubular portion extending from said upper portion having an opening at a lower end thereof through which objects and materials are passed from said opening in said channel upper portion and discharged from said opening at said channel portion lower end.

13. A playground apparatus according to claim 12 wherein said tubular channel has an outwardly curved upper portion associated with said hood portion, an opening in said outwardly curved upper portion, and a pair of elongate tubular channels extending therefrom each having an opening at a lower end thereof through which objects and materials are passed from said opening in said outwardly curved upper portion and discharged from said opening at said lower end of each of said pair of tubular channels.

14. A playground apparatus comprising:

a deck supported a distance above a ground surface by at least one vertical column; and an elongate tubular channel on the exterior of said at least one column;

said tubular channel having an opening at an upper end and an opening at a lower end through which objects and materials are passed from said opening in said upper end and discharged from said opening in said lower end by a person standing on said deck.

15. A playground apparatus comprising:

a curved hood sized and shaped to be installed on an existing slide device;

said hood having a tubular channel with an opening at an upper end and an opening at a lower end through which objects and materials are passed from said channel upper end and discharged from said channel lower end.

16. A tubular channel for attachment to existing playground apparatus, said channel comprising;

an elongate tubular channel member having an opening at a first end and an opening at a second end; and means for securing said tubular channel member to existing playground apparatus with said first end elevated above said second end relative to a ground surface; whereby objects and materials are passed from said opening in said channel member first end and discharged from said opening in said channel member second end.

17. A tubular channel according to claim 16, wherein said tubular channel member is sized and shaped to be secured to an existing slide device having a longitudinal bedway on which a person slides.

18. A tubular channel according to claim 17 wherein the existing slide device has a curved portion at least partially surrounding said longitudinal bedway; and said tubular channel member has a curved upper first end portion sized and shaped to be secured to said curved portion of said existing slide device and at least one longitudinal tubular portion extending therefrom adjacent to said longitudinal bedway and terminating at said second end;

said opening at said channel member first end disposed in said curved upper first portion and said opening at said channel member second end disposed adjacent a lower portion of said longitudinal bedway; whereby objects and materials are passed from said opening in said channel member curved first end portion, through said at least one longitudinal tubular portion and discharged from said opening in said channel member second end.

19. A tubular channel according to claim 17, wherein said tubular channel member is sized and shaped to be secured on a side wall adjacent to a handrail at at least one side of said longitudinal bedway of said existing slide device.

20. A tubular channel according to claim 17, wherein said tubular channel member is sized and shaped to be secured on an underside of said longitudinal bedway of said existing slide device.

21. A tubular channel according to claim 16, wherein said tubular channel member has a lower portion sized and shaped to be secured to an existing slide device and an upper portion shaped to be secured to a vertical column supporting a deck a distance above a ground surface, said opening in said first end disposed in said upper portion and said opening at said second end disposed in said lower portion; whereby objects and materials are passed from said opening in said channel member upper portion and discharged from said opening in said channel member lower end by a person standing on said deck.

22. A tubular channel according to claim 16, wherein said tubular channel member is sized and shaped to be secured to an existing vertical column supporting a deck a distance above a ground surface, said channel member first end disposed adjacent to an upper end of said column and said channel second end disposed adjacent to a lower end of said column; whereby objects and materials are passed from said opening in said channel member first end and discharged from said opening in said channel member second end by a person standing on said deck.

* * * * *